US005271346A

United States Patent [19]

Mori

[11] Patent Number: 5,271,346

[45] Date of Patent: Dec. 21, 1993

[54] DRIVING DEVICE FOR A SEWING MACHINE

[75] Inventor: Shushin Mori, Nagoya, Japan

[73] Assignee: Brother Kogyo Kabushiki Kaisha, Nagoya, Japan

[21] Appl. No.: 764,821

[22] Filed: Sep. 24, 1991

[30] Foreign Application Priority Data

Nov. 10, 1990 [JP] Japan ..... 2-304564

[51] Int. Cl.[5] ..... D05B 69/12

[52] U.S. Cl. ..... 112/220; 112/277

[58] Field of Search ..... 112/220, 221, 271, 275, 112/277; 318/799

[56] References Cited

U.S. PATENT DOCUMENTS

| | | | |
|---|---|---|---|
| 4,364,001 | 12/1982 | Heidt et al. | 112/277 X |
| 4,490,656 | 12/1984 | Arnold | 112/277 X |
| 4,541,349 | 9/1985 | Inoue | 112/221 |
| 4,883,008 | 11/1989 | Hiramatsu | 112/277 X |
| 5,018,466 | 5/1991 | Hasegawa | 112/275 |

FOREIGN PATENT DOCUMENTS

| | | |
|---|---|---|
| 0112949 | 7/1984 | European Pat. Off. . |
| 57-97381 | 6/1982 | Japan . |
| 61-122894 | 6/1986 | Japan . |
| 1-45398 | 10/1989 | Japan . |
| WO82/03879 | 11/1982 | PCT Int'l Appl. . |
| 2081033 | 2/1982 | United Kingdom . |

*Primary Examiner*—Peter Nerbun

*Attorney, Agent, or Firm*—Oliff & Berridge

[57] ABSTRACT

In a sewing machine, a judgment is made whether a needle speed is above or below a threshold speed. When the needle speed is above the threshold speed, meaning the machine is sewing normally, a constant power is supplied at a level associated with a foot pedal setting. When the needle speed drops below the threshold, the power is alternated between power on and power off states to drive the needle in a manner similar to a hammer driving a nail. The indication of needle speed may be obtained by measuring the rotating speed of the sewing machine motor, judging the load applied to sewing machine motor, or by detecting the driving current supplied to the sewing machine motor.

15 Claims, 10 Drawing Sheets

DRIVING DEVICE FOR A SEWING MACHINE

BACKGROUND OF THE INVENTION

1. Field of the Invention

The invention relates to a sewing motor driving device.

2. Description of Related Art

On a main shaft of a conventional sewing machine, a sewing machine pulley is fixed and a motor pulley is fixed on an output shaft of a sewing motor. The sewing machine and the sewing motor are connected by a belt which extends between the sewing machine pulley and the motor pulley. In sewing a thick fabric on the conventional sewing machine, the torque of the main shaft of the sewing machine is increased by reducing the working diameter of the motor pulley to enhance the penetrating force of the needle or by employing a sewing motor having an increased capacity.

The reduction of the working diameter of the motor pulley, to enhance the torque of the main shaft at a low sewing speed, however, entails a reduction in the maximum sewing speed. The employment of a sewing motor of a high rated power increases the cost of the sewing machine.

SUMMARY OF THE INVENTION

An object of the invention is to provide a driving device for a sewing machine capable of increasing the penetrating force of a needle during low-speed sewing operation without requiring a sewing motor of a higher rated power and the commensurate reduction in the maximum sewing speed.

To achieve the object, a driving device according to the invention, for a sewing machine which has a main shaft and a needle reciprocated in accordance with the rotation of the main shaft to penetrate a work fabric, includes power supply means for supplying power to the main shaft so as to rotate the main shaft and intermittent driving means for alternately generating a deenergizing signal so as to deenergize the power supply means and an energizing signal so as to energize the power supply means. The intermittent driving means generates the deenergizing signal during a period longer than a period in which lowering of the needle is stopped, and generates the energizing signal during a period longer than a period in which lowering of the needle is started, i.e. longer than a period to overcome machine inertia, and other movement resistant conditions, after application of a current.

In the driving device for the sewing machine of the invention, the intermittent driving means alternately generates the deenergizing signal and the energizing signal. When the deenergizing signal is generated by the intermittent driving means, the power supply means stops supplying power to the main shaft. On the other hand, when the energizing signal is generated by the intermittent driving means, the power supply means starts supplying power to the main shaft. Accordingly, the power is intermittently supplied to the main shaft when the deenergizing signal and the energizing signal are alternately generated by the intermittent driving means. Consequently, an impulsive force like an impulsive force applied to a nail with a hammer is applied to the needle to enhance the penetrating force of the needle.

As mentioned above, the driving device for the sewing machine according the invention can apply the impulsive force to the needle. Therefore, the driving device is capable of increasing the penetrating force of a needle during low-speed sewing operation without requiring a sewing motor of a higher torque rating with a reduced maximum sewing speed.

BRIEF DESCRIPTION OF THE DRAWINGS

A preferred embodiment of the invention will be described in detail with reference to the following figures wherein.

DETAILED DESCRIPTION OF THE PREFERRED EMBODIMENT

The sewing motor driving devices of the preferred embodiments according to the invention will be described hereinafter with reference to the accompanying drawings.

Figure 1:
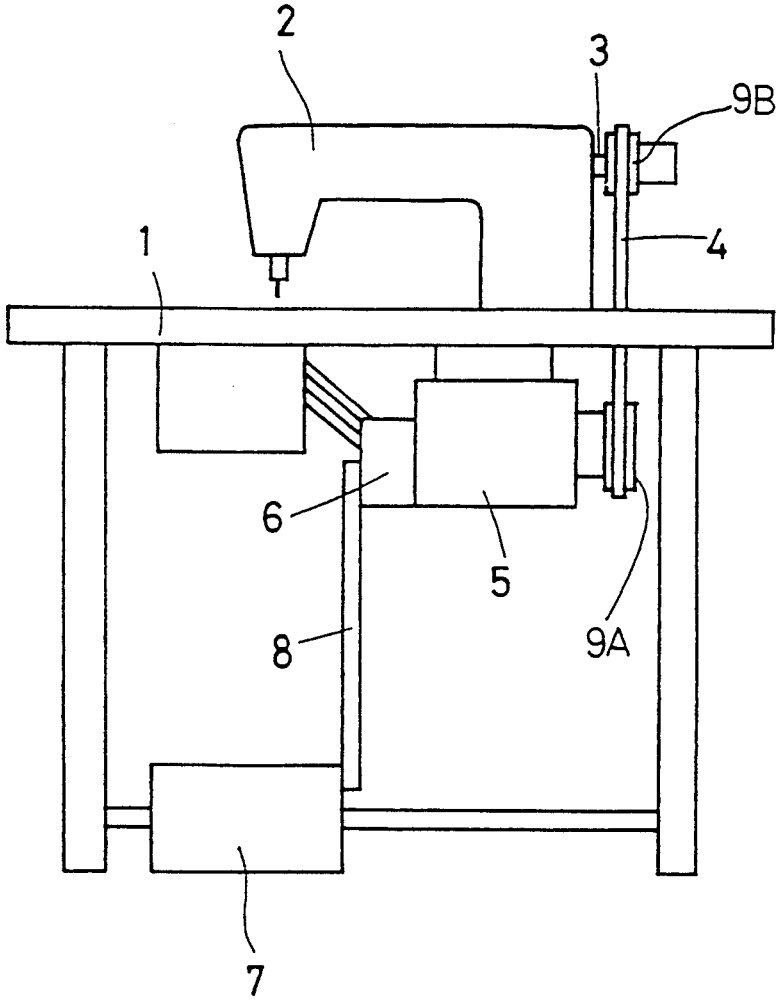
FIG. 1 is a front view of a sewing machine which employs a driving device in a first embodiment.

Referring to FIG. 1, an industrial sewing machine 2 is mounted on a table 1. A pulley 9B is fixed on a main shaft 3 of the sewing machine 2. A pulley 9A is fixed on an output shaft of a sewing motor 5 held under the table 1. A dc motor is used as the sewing motor 5.

The main shaft 3 is driven, by a belt 4 extending between the pulleys 9A and 9B, by the sewing motor 5. A sewing motor driving device 6 is attached to one side of a bracket holding the sewing motor 5. A control pedal 7 is connected to a main switch included in the sewing motor driving device 6 by a connecting rod 8. An electromagnetic brake 19 (not shown) is provided between the sewing motor 5 and the pulley 9A.

Figure 2:
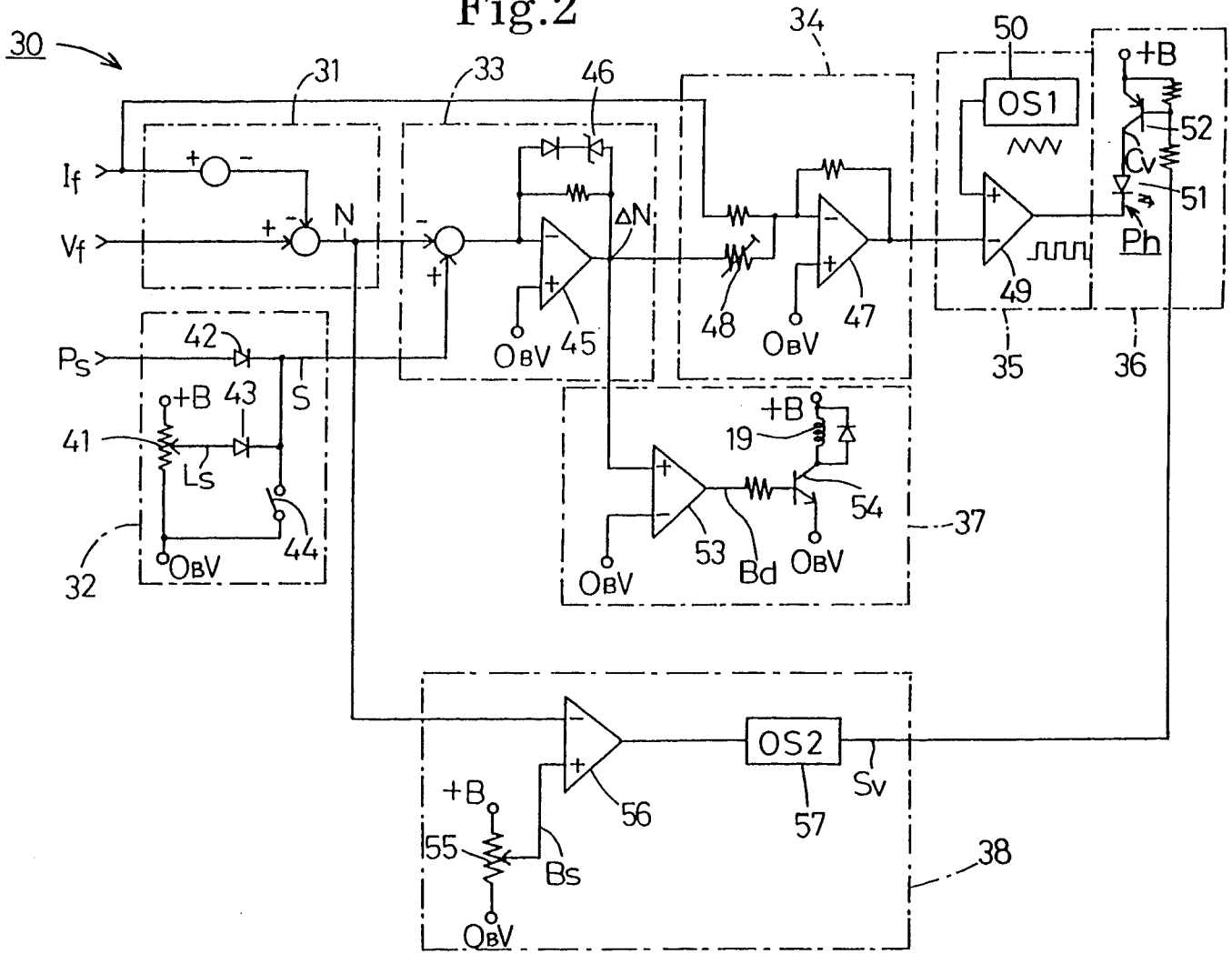
FIG. 2 is a circuit diagram of a control circuit employed in the driving device.
Figure 3:
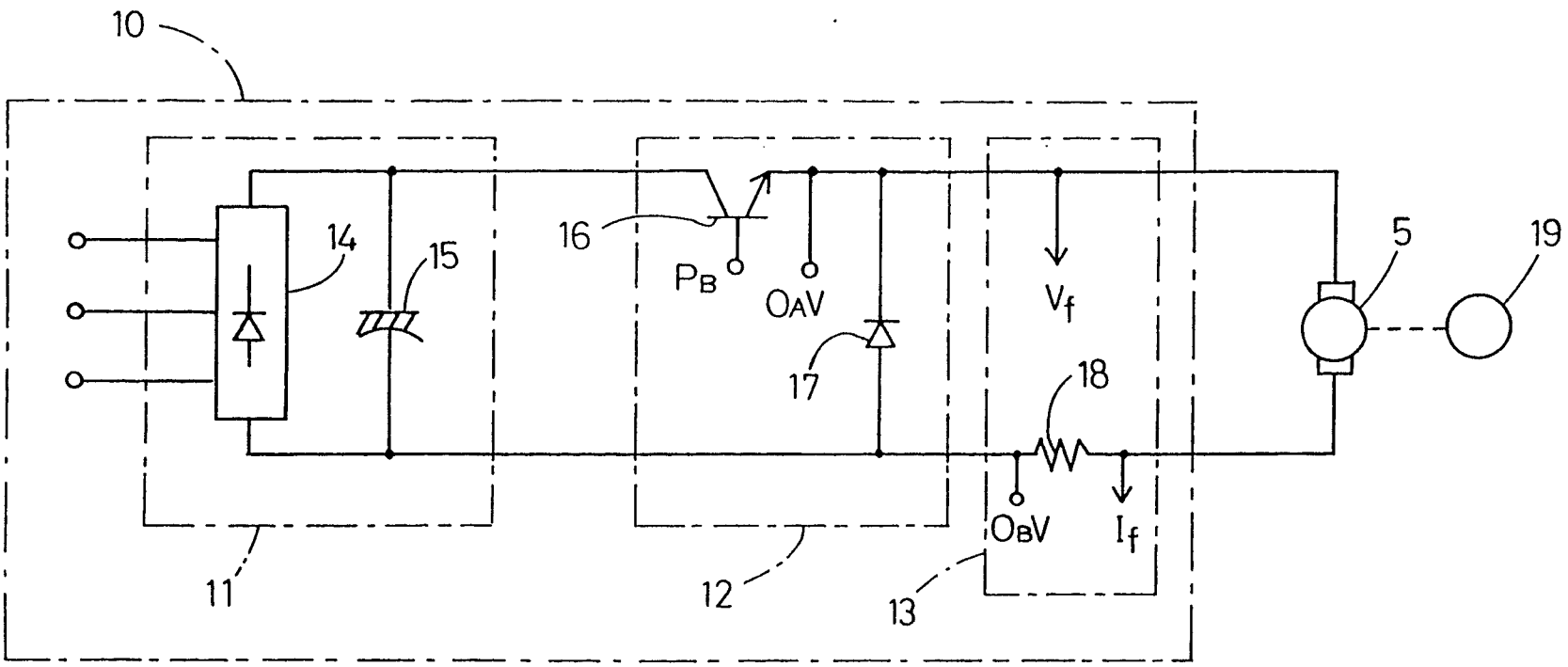
FIG. 3 is a circuit diagram of a driving circuit employed in the driving device.
Figure 4:
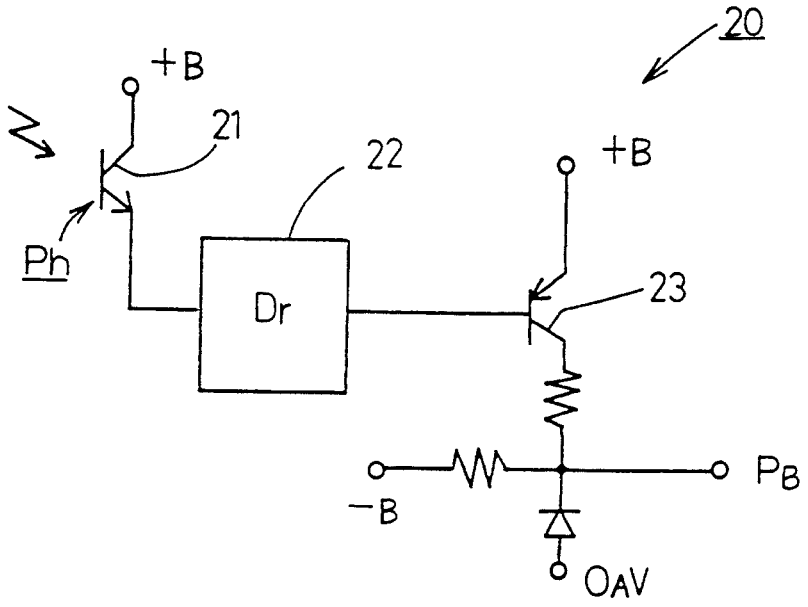
FIG. 4 is a circuit diagram of a power transistor driving circuit employed in the driving device.

FIGS. 2 to 4 are circuit diagrams of the sewing motor driving device 6. A driving circuit 10, shown in FIG. 3, comprises a power supply unit 11, a driving element unit 12 and a feedback unit 13. The power supply unit 11 comprises a diode bridge 14 for rectifying a commercial alternating current and a smoothing capacitor 15.

The driving element unit 12 comprises a power transistor 16 connected in series to the armature of the sewing motor 5 to interrupt the current and a freewheel diode 17 connected in parallel to the armature. The base terminal PB and emitter terminal OAV of the power transistor 16 are connected to a power transistor driving circuit 20 shown in FIG. 4.

The feedback unit 13 comprises a current detecting resistor 18 having one end connected to a ground. The feedback unit 13 sends a voltage signal Vf, corresponding to the armature voltage of the sewing motor 5, and a current signal If, corresponding to the armature current, to a control circuit 30 shown in FIG. 2. The electromagnetic brake 19 is connected to the sewing motor 5.

As shown in FIG. 4, the power transistor driving circuit 20 comprises, as principal components, a phototransistor 21, i.e., one of the components of a photocoupler Ph, a driver 22 driven by a signal provided by the phototransistor 21, and a transistor 23. A base current proportional to a light signal provided by a light emitting diode 51, included in the control circuit 30, is supplied to the power transistor 16 (FIG. 3) to turn the power transistor on and off.

As shown in FIG. 2, the control circuit 30 comprises a rotating speed detecting unit 31 which detects a rotating speed N of the motor 5 on the basis of the voltage signal Vf and the current signal If provided by the feedback unit 13 of the driving circuit 10, a speed command unit 32 which provides a rotating speed command voltage S, a rotating speed deviation calculating unit 33 for calculating a rotating speed deviation ΔN, a deviation amplifying unit 34 for matching the rotating speed deviation ΔN and motor driving current I, a pulse width modulating unit (abbreviated to "PWM unit") 35 for modulating pulse width according to the output of the deviation amplifying unit 34, a photocoupling unit 36 for driving the power transistor driving circuit 20 according to the output of the PWM unit 35, a brake driving unit 37 for driving the electromagnetic brake 19, and an intermittent current control unit 38, which is an essential component of the sewing motor driving device 6 of the present invention.

The rotating speed detecting unit 31 subtracts the current signal If from the voltage signal Vf to calculate a voltage corresponding to the rotating speed N of the motor 5. The speed command unit 32 comprises a known circuit that provides a command voltage Ps corresponding to the position of the control pedal 7, a variable resistor 41 to provide a minimum speed command voltage Ls, an OR circuit consisting of two diodes 42 and 43 to provide the logical one of the command voltage Ps and the minimum speed command voltage Ls, and a switch 44 to reduce the rotating speed command voltage S to zero V. The OR circuit outputs one of the command voltage Ps and the minimum speed command voltage Ls, whichever has greater level. The switch 44 is a normally closed switch which is opened when the control pedal 7 is moved down even if the movement is very small.

The rotating speed deviation calculating unit 33 has a first amplifier 45 which calculates the rotating speed deviation ΔN between the rotating speed command voltage S and the rotating speed N of the motor 5. The negative maximum value of the rotating speed deviation ΔN is limited by a Zener diode 46.

The deviation amplifying unit 34 has a second amplifier 47 which subtracts the current signal If from the rotating speed deviation ΔN to limit substantially the maximum current supplied to the motor 5. The maximum current is regulated by a variable resistor 48.

The PWM unit 35 has a first comparator 49 which compares a triangular pulse signal generated by a carrier pulse oscillator (OS1) 50 and the output signal of the deviation amplifying unit 34 and provides a rectangular pulse signal of a pulse width corresponding to the rotating speed deviation ΔN. The frequency of a carrier pulse signal generated by the carrier pulse oscillator 50 is 2 kHz.

The photocoupling unit 36 comprises, as principal components, the light emitting diode 51, i.e., one of the two components of the photocoupler Ph, and a transistor 52 connecting the light emitting diode 51 to the power source. The light emitting diode 51 and the phototransistor 21 of the power transistor driving circuit 20 constitute the photocoupler Ph. While the transistor 52 of the photocoupling unit 36 is held ON, the light emitting diode 51 is turned on and off according to the output signal of the PWM unit 35 to turn on and off the power transistor 16 through the power transistor driving circuit 20.

The brake driving unit 37 comprises, as principal components, a second comparator 53 and a transistor 54. The output signal Bd of the second comparator 53 becomes HIGH when the rotating speed deviation ΔN changes to a positive value. As a result, the transistor 54 is held ON, the current is supplied to the coil of the electromagnetic brake 19 and the motor 5 is braked.

The intermittent current control unit 38, i.e., an essential component of the sewing motor driving device 6 of the present invention, comprises a variable resistor 55 for providing a low-speed reference voltage Bs, a comparator 56 which compares the low-speed reference voltage Bs and the rotating speed N of the motor 5 detected by the rotating speed detecting unit 31 and provides an output signal when the rotating speed N is lower than the low-speed reference voltage Bs, and a second pulse oscillator (OS2) 57 which generates a rectangular pulse signal of 25 Hz in response to the output signal of the comparator 56. The low-speed reference voltage Bs is lower than the minimum speed command voltage Ls. For example, the minimum speed command voltage Ls corresponds to a rotating speed of 200 rpm of the main shaft 3 and the low-speed reference voltage Bs corresponds to a rotating speed of 60 rpm of the same.

The output terminal of the third comparator 56 is connected to the input terminal of the second pulse oscillator 57, and the output terminal of the second pulse oscillator 57 is connected to the base of the transistor 52 of the photocoupling unit 36. When the output signal Sv of the second pulse oscillator 57 is HIGH, the collector voltage Cv becomes LOW. When the output signal Sv of the second pulse oscillator 57 is LOW, the transistor 52 remains ON and, consequently, the light emitting diode 51 is turned on and off according to the output signal of the PWM unit 35.

Figure 5:
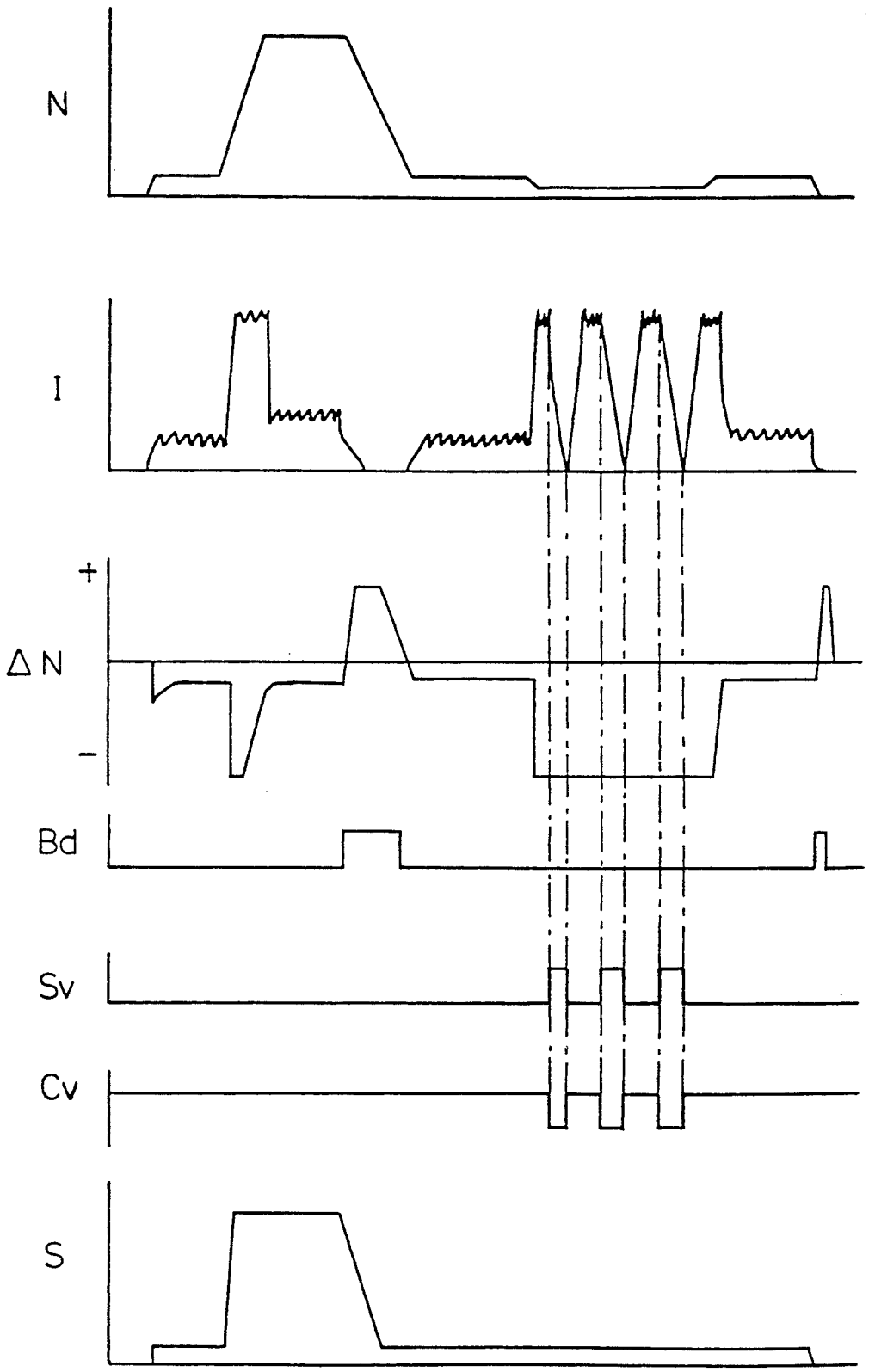
FIG. 5 shows waveform charts of assistance in explaining the operation of the driving device in the first embodiment.

The operation of the sewing motor driving device 6 will be described hereinafter with reference to FIG. 5.

While the control pedal 7 is not operated, the switch 44 of the speed command unit 32 is closed, the rotating speed command voltage S is zero V, the motor 5 is inoperative and hence the rotating speed deviation ΔN is zero. When the control pedal 7 is moved down a little to open the switch 44, the rotating speed command voltage S equal to the minimum speed command voltage Ls is applied through the resistor 41 to the motor 5, and then the motor 5 rotates at a low rotating speed corresponding to the minimum speed command voltage Ls. In this state, the command voltage Ps is lower than the minimum speed command voltage Ls.

When the control pedal 7 is moved further down, the command voltage Ps corresponding to the downward movement of the control pedal 7 is applied to the motor 5, and the difference between the rotating speed N and the rotating speed command voltage S increases, so that the negative value of the rotating speed deviation ΔN increases sharply. The negative maximum value of the rotating speed deviation ΔN is limited by the Zener diode 46. When the rotating speed deviation ΔN reaches the negative maximum value, the motor driving current I supplied to the motor 5 reaches a maximum value determined by the variable resistor 48, so that the motor 5 completes acceleration in a short time. As the rotating speed N approaches the command voltage Ps, the negative value of the rotating speed deviation ΔN decreases and the motor driving current I decreases to drive the motor 5 at the rotating speed N corresponding to the command voltage Ps. The motor driving current I is controlled in a PWM control mode at a frequency of 2 kHz according to the frequency of the carrier pulse signal of the carrier pulse oscillator 50 in the PWM unit 35.

When the control pedal 7 is moved up (put back) a little, the rotating speed command voltage S coincides with the minimum speed command voltage Ls, the value of the rotating speed deviation ΔN changes from a negative value to a positive value. As a result, the output signal Bd of the second comparator 53 of the brake driving unit 37 becomes HIGH and the transistor 54 is held ON. Then, the current is supplied to the coil of the electromagnetic brake 19 and the motor 5 is braked. Consequently, the rotating speed N of the motor decreases and hence the positive value of the rotating speed deviation ΔN decreases. Then, the electromagnetic brake 19 is released, the rotating speed deviation ΔN changes again from a positive value to a small negative value, the motor driving current I is supplied to the motor 5 and the motor 5 continues rotation at a low rotating speed. The foregoing mode of operation is the same as that of the conventional sewing motor driving device.

If the load on the motor 5 increases sharply while the motor 5 is rotating at the low rotating speed corresponding to the minimum speed command voltage Ls, namely, if the thickness of the work being sewn increases suddenly or if the sewing machine starts sewing a portion of the work lined with padding cloth, the rotating speed N of the motor 5 drops, the negative value of the rotating speed deviation ΔN increases sharply, and then a limited maximum current is supplied to the motor 5. Thus, the torque of the motor 5 reaches a maximum torque. If the load on the motor 5 requires a torque greater than the maximum torque, the rotating speed N of the motor 5 decreases. Since the conventional sewing motor driving device merely maintains the maximum torque by supplying the maximum current to the motor, the needle is unable to penetrate the work and the motor 5 is brought to a stop if the load exceeds the maximum torque.

In such a state, the intermittent current control unit 38 of the sewing motor driving device 6 of the present invention functions. If the rotating speed N decreases below the low-speed reference voltage Bs, the third comparator 56 provides a positive output signal, and then the second pulse oscillator 57 generates a rectangular pulse signal of 25 Hz. While the output signal SV of the second pulse oscillator 57 is HIGH, the transistor 52 of the photocoupling unit 36 is held OFF and the collector voltage Cv of the transistor 52 becomes LOW. As a result, the light emitting diode 51 is turned off and, hence, the power transistor 16 is turned off. The period of the rectangular pulse signal provided by the second oscillator 57 is 40 msec, which is very long as compared with the period of 0.5 msec of the carrier pulse signal of a frequency of 2 kHz provided by a carrier pulse oscillator (OS1) 50. Accordingly, the motor driving current I flowing through the freewheel diode 17 is attenuated to nearly zero. While the output signal Sv of the second pulse oscillator 57 is LOW and the transistor 52 of the photocoupling unit 36 is ON, the motor driving current I is controlled in a PWM control mode to the maximum current.

Figure 10:
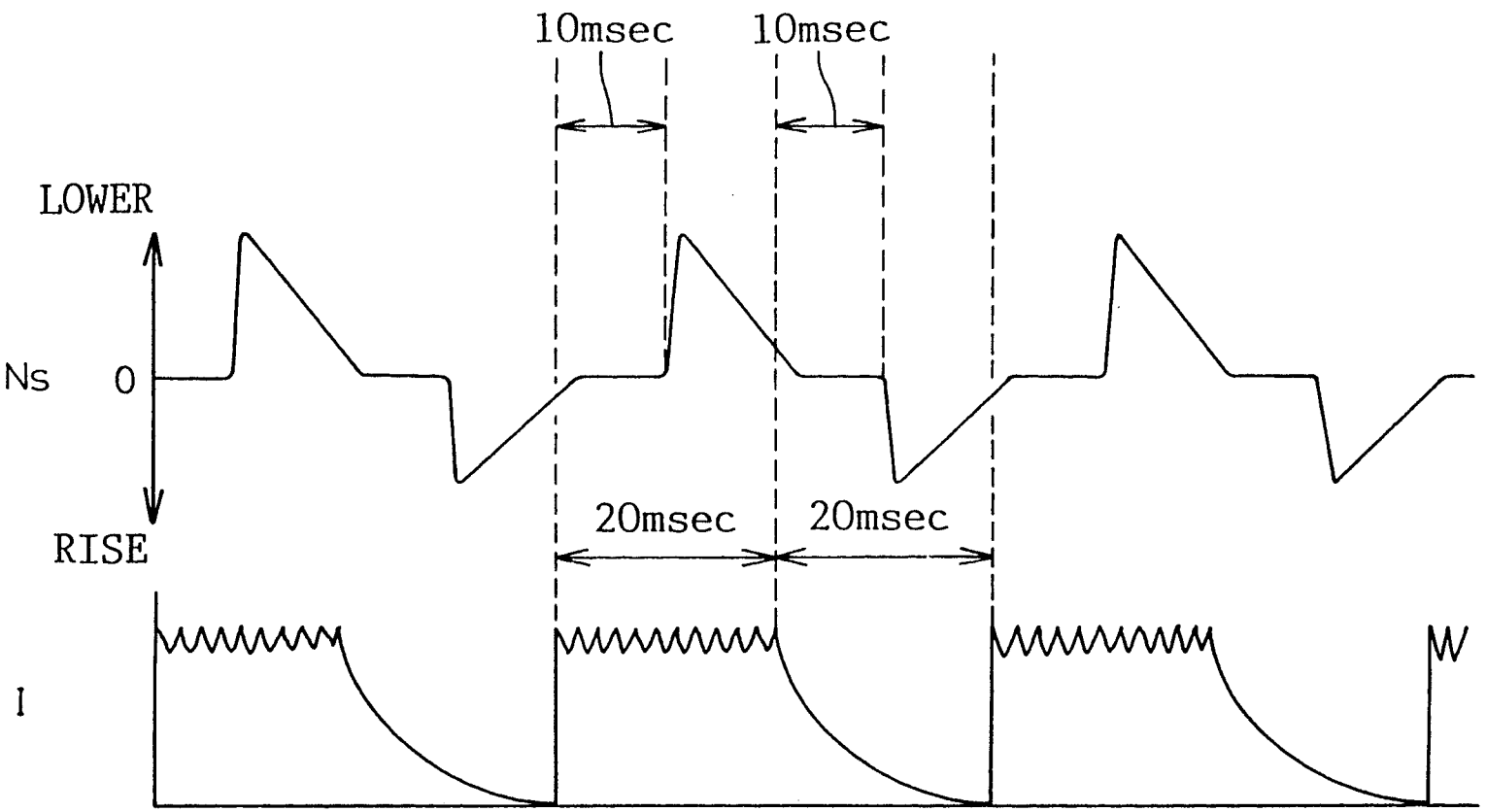
FIG. 10 shows waveform charts of assistance in explaining the relation between a motor driving current and a speed of a needle.

Thus, the motor driving current I is varied periodically between zero and the maximum current so that the sewing motor 5 produces torque intermittently. As a result, as shown in FIG. 10, the speed of the needle Ns reaches a minimum during 20 msec when the output signal Sv of the second pulse oscillator 57 is HIGH, that is, while the motor driving current I is not supplied. On the other hand, the speed of the needle Ns reaches maximum during 20 msec when the output signal Sv of the second pulse oscillator 57 is LOW, that is, while the motor driving current I is supplied. Even if supplying of the motor driving current I is stopped, the needle does not start rising for about 10 msec. On the other hand, when supplying of the motor driving current I is started, the needle does not start lowering for about 10 msec. Such delays depend on inertia of the mechanism for transmitting the power of the sewing motor 5 to the needle, an elasticity of the belt 4, and reaction force of the work fabric. In this embodiment, the second oscillator 57, which outputs the rectangular pulse signal at a period of 40 msec, is used so that the time for prohibiting the supply of the motor driving current I and for permitting the supply of the motor driving current I are respectively set at 20 msec, a period longer than the machine derived 10 msec delays. Accordingly, the motor driving current I is reduced to zero when the needle is urging the work fabric downwardly, so that the needle is pushed slightly upward by the reaction force of the work fabric. Then, the maximum driving current is supplied to the sewing motor 5, so that the needle is lowered against the reaction force of the work fabric. Consequently, an impulsive force like an impulsive force applied to a nail by a hammer is applied intermittently to the needle to enhance its penetrating force.

The intermittent current control unit 38 functions when the rotating speed N of the motor 5 is lower than the low-speed reference voltage Bs. In such a condition, the sewing motor 5 is operating at the low rotating speed and the load on the sewing motor 5 is excessively high because the minimum speed command voltage Ls corresponds to the minimum command speed.

After the penetrating force of the needle has been enhanced, and the needle has penetrated the work, the rotating speed N of the motor 5 increases again, so that the rotating speed deviation ΔN decreases, the motor driving current I decreases and the motor 5 continues operation at a low rotating speed corresponding to the minimum speed command voltage Ls. When the control pedal 7 is released, the switch 44 of the speed command unit 32 closes, the rotating speed command voltage S drops to zero V to apply the electromagnetic brake 19 and, consequently, the motor 5 stops.

Sewing tests were performed to confirm the effect of the foregoing sewing motor driving device, in which a needle and a thread for sewing very thick workpieces and a twin needle sewing machine were used. The sewing ability of the twin needle sewing machine in sewing multilayered works, formed by superposing a plurality of pieces of a special, hard fabric (for example, a denim which is used for jeans), was evaluated. When the conventional sewing motor control device was employed, the needles penetrated six-layer test workpieces successfully, however, the needles could not penetrate seven-layer test workpieces. When the sewing motor driving device of this embodiment of the invention was used, eighteen-layer test workpieces could be penetrated. It is clear from these sewing tests that the penetrating force is approximately tripled using the sewing motor driving device of the invention.

In the foregoing embodiment, an operating condition in which the sewing motor 5 is operating at the low rotating speed under an excessively large load is identified by detection of the reduction of the rotating speed N below the low-speed reference voltage Bs which is lower than the minimum speed command voltage Ls. At that time the intermittent power supply means is actuated. Such an operating condition, one that requires the function of the intermittent power supply means may be identified by other methods.

Figure 6:
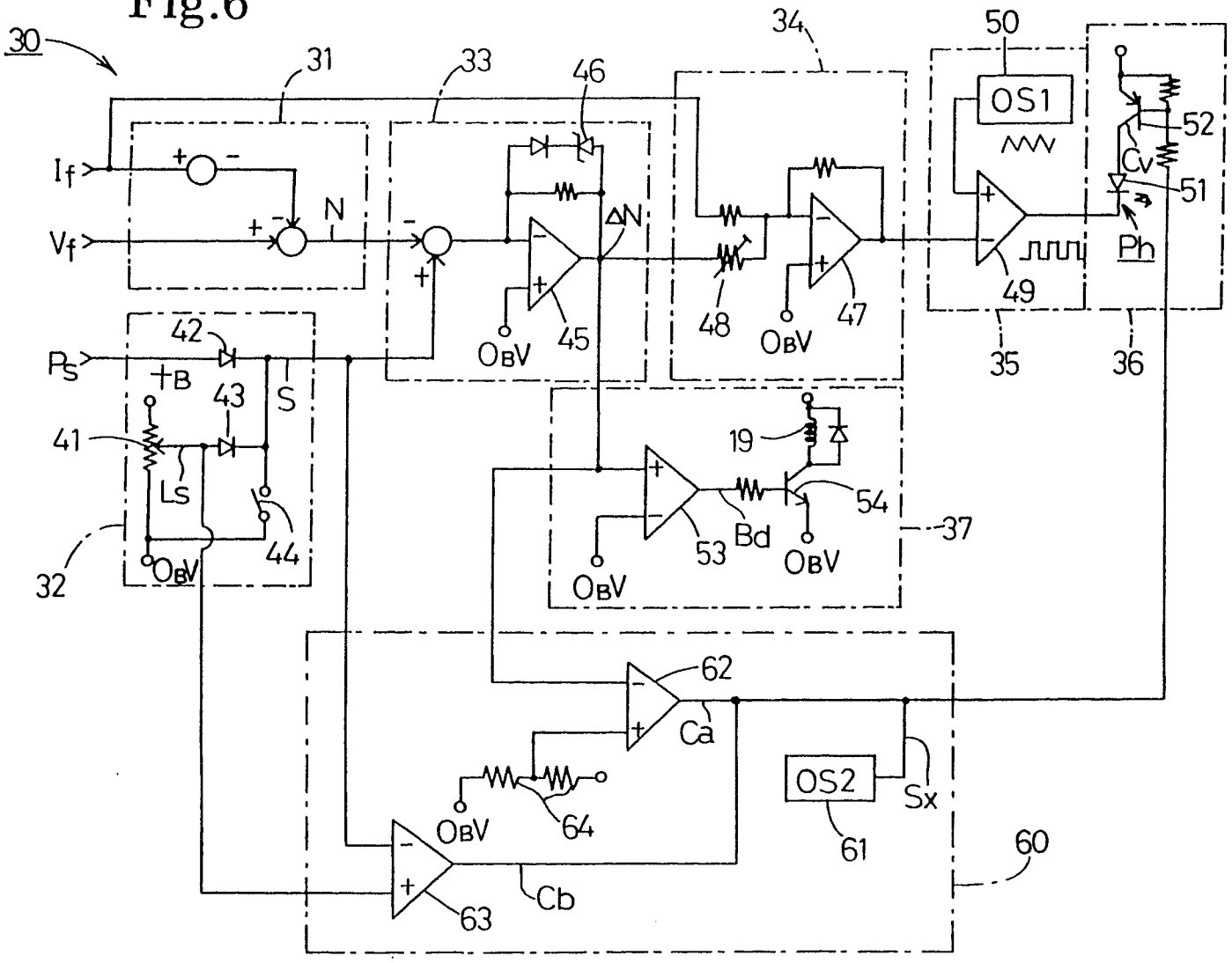
FIG. 6 is a circuit diagram of a control circuit employed in a driving device in a second embodiment.

FIG. 6 is a circuit diagram of a second embodiment of the present invention of a control circuit employed in a sewing motor driving device. The driving circuit 10 and the power transistor driving circuit 20 used in the second embodiment are the same as those shown in FIGS. 3 and 4, respectively. However, this second embodiment, the intermittent power supply means is actuated if the speed command with the minimum speed command voltage Ls and the negative value of the rotating speed deviation ΔN has increased. In FIG. 6 parts like or corresponding to those shown in FIG. 2 are denoted by the same reference characters and the description thereof will be omitted.

The sewing motor driving device in the second embodiment employs a second intermittent current control unit 60 instead of the intermittent current control unit 38 shown in FIG. 2. The second intermittent current control unit 60 comprises a second pulse oscillator (OS2) 61 that generates a rectangular pulse signal Sx of 25 Hz, a fourth comparator 62 for detecting the excessive increase of the negative value of the rotating speed deviation ΔN, a fifth comparator 63 for detecting the coincidence of a speed command with the minimum speed command voltage Ls, and a resistance type potential divider 64.

Figure 7:
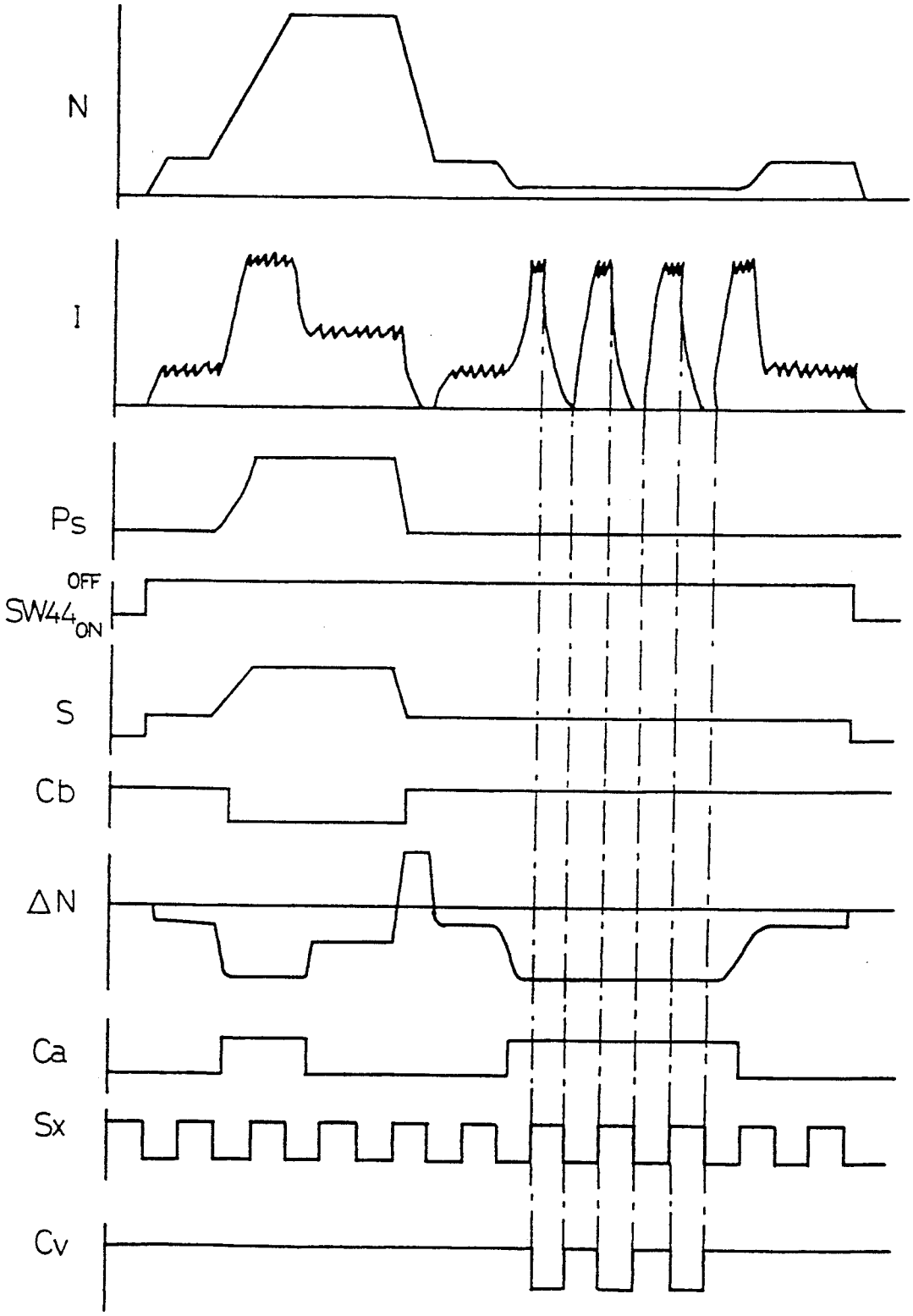
FIG. 7 shows waveform charts of assistance in explaining the operation of the sewing motor driving device in the second embodiment.

FIG. 7 shows waveform charts of assistance in explaining the operation of the sewing motor driving device. The mode of operation of the sewing motor driving device for normal acceleration and normal deceleration is the same as that shown in FIG. 5 and hence the description thereof will be omitted. The output signal Ca of the fourth comparator 62 goes HIGH when the absolute value of the rotating speed deviation ΔN detected by the fourth comparator 62 increases beyond a predetermined value. The fifth comparator 63 compares the minimum speed command voltage Ls, determined by the resistor 41, and the rotating speed command voltage S and the output signal Cb of the fifth comparator 63 goes HIGH if the minimum speed command voltage Ls is higher than the rotating speed command voltage S. If the command voltage Ps is lower than the minimum speed command voltage Ls, the rotating speed command voltage S is lower than the minimum speed command voltage Ls by a voltage corresponding to the forward voltage drop across the diode 43. When all the output signals Ca, Cb and Sx of the fourth comparator 62, the fifth comparator 63 and the second pulse oscillator 61 respectively are HIGH, the transistor 52 of the photocoupling unit 36 is held OFF and the collector voltage Cv of the transistor 52 becomes LOW. Then the light emitting diode 51 is turned off and the motor driving current I supplied to the motor is interrupted.

Figure 8:
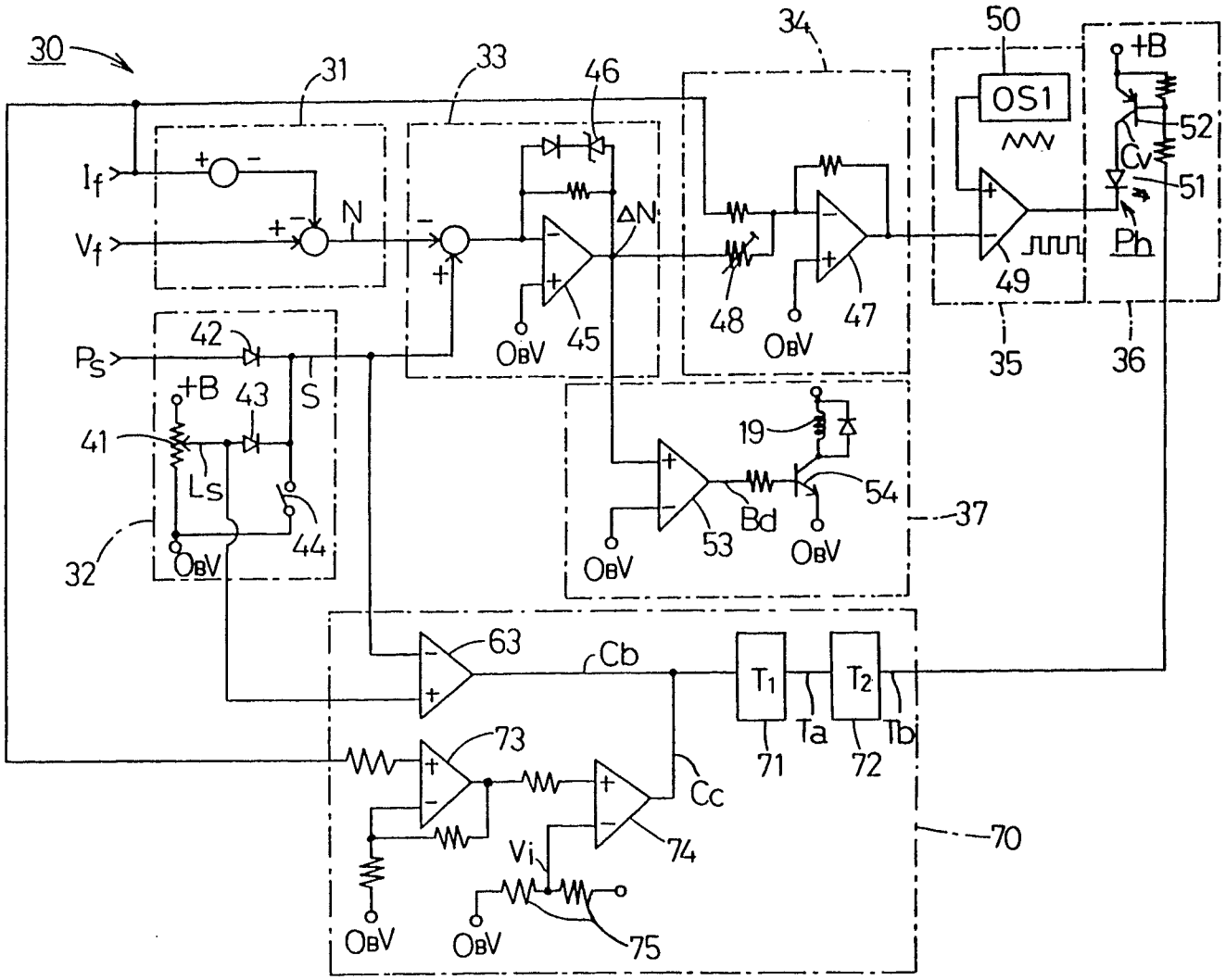
FIG. 8 is a circuit diagram of a control circuit employed in a driving device in a third embodiment.

FIG. 8 shows a circuit diagram for a third embodiment, of the invention, of a control circuit employed in a sewing motor driving device. In the third embodiment, the intermittent power supply means is actuated if the speed command coincides with the minimum speed command voltage Ls and the motor driving current I has increased. In FIG. 8 parts like or corresponding to those shown in FIG. 2 are denoted by the same reference characters and the description thereof will be omitted.

The sewing motor driving device in the third embodiment employs a third intermittent current control unit 70 instead of the intermittent current control unit 38 of FIG. 2. The third intermittent current control unit 70 comprises two timers 71 and 72, namely, one-shot multivibrators having an operating time of 20 msec, a fifth comparator 63 for comparing the speed command and the minimum speed command voltage Ls, a third amplifier 73 for amplifying the current signal If, a sixth comparator 74 for comparing the amplified current signal and a predetermined voltage Vi, and a resistance type potential divider 75 for providing the predetermined voltage Vi. The predetermined voltage Vi corresponds to a value slightly lower than a limit current regulated by the variable resistor 48 of the deviation amplifying unit 34.

Figure 9:
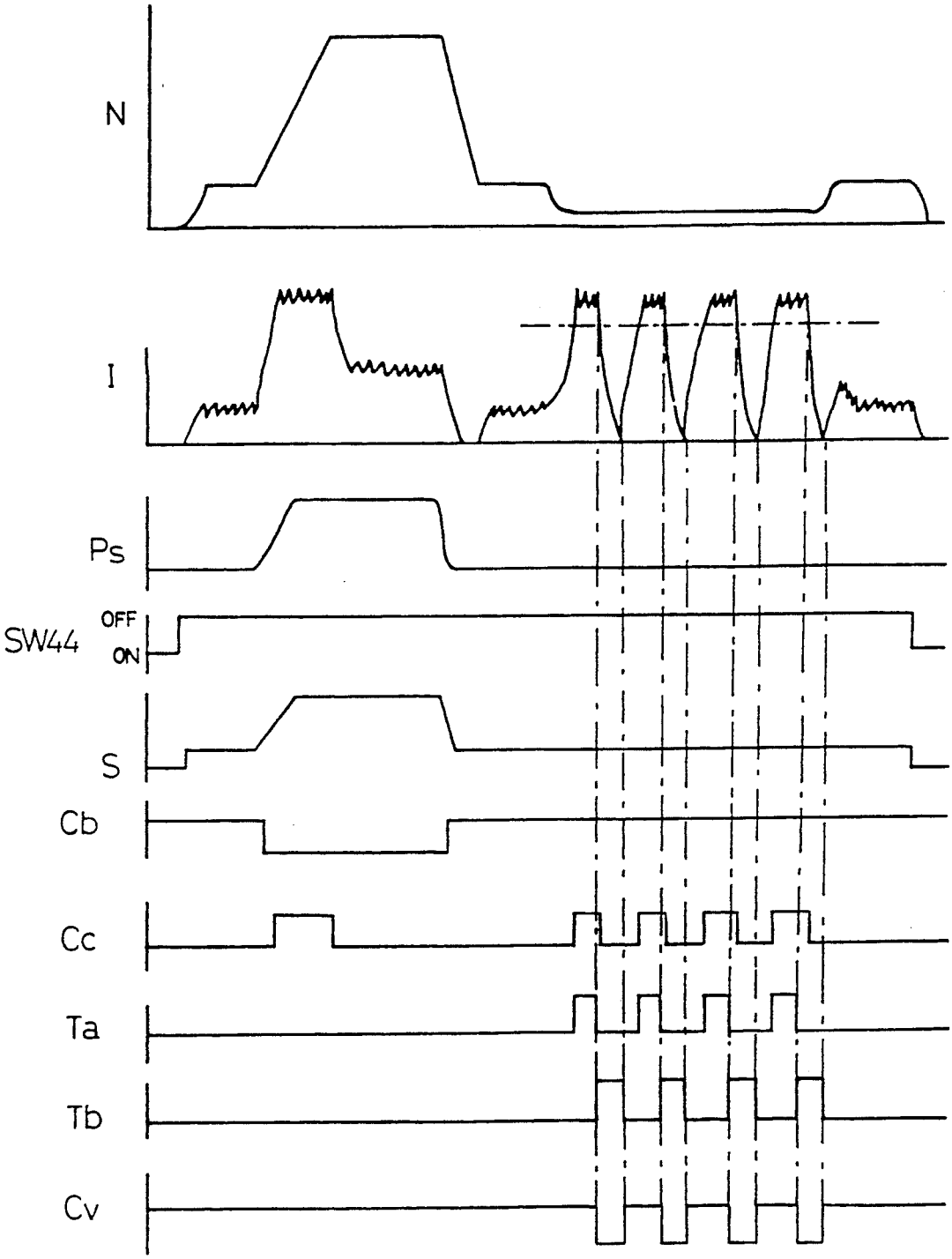
FIG. 9 shows waveform charts of assistance in explaining the driving device in the third embodiment.

FIG. 9 shows waveform charts of assistance in explaining the operation of the sewing motor driving device of the third embodiment. The mode of operation of the sewing motor driving device in accelerating and decelerating the sewing motor is the same as that shown in FIG. 5 and, hence, the description thereof will be omitted.

The fifth comparator 63 compares the minimum speed command voltage Ls determined by the resistor 41 and the rotating speed command voltage S and the output signal Cb goes HIGH when the minimum speed command voltage Ls is higher than the rotating speed command voltage S. The output signal Cc of the sixth comparator 74 goes HIGH when the motor driving current I is increased nearly to the limit current. Accordingly, upon the coincidence of the rotating speed command voltage S with the minimum speed command voltage Ls and the increase of the motor driving current I nearly to the limit current, the first timer 71 is triggered and the output Ta of the first timer 71 held HIGH during 20 msec. The second timer 72 is triggered when the output Ta of the first timer 71 becomes LOW after 20 msec has passed. When the second timer 72 is triggered, the output Tb of the second timer 72 is held HIGH during 20 msec. During a time period of 20 msec in which the output of the second timer 72 is HIGH, the transistor 52 of the photocoupling unit 36 is turned off and the collector voltage Cv of the transistor 52 becomes LOW. Then the light emitting diode 51 is turned off so that the motor driving current I is interrupted. Thus, the motor driving current I is alternated periodically during a period of 40 msec, with the motor driving current I being supplied for 20 msec and then stopped for 20 msec.

Although the present invention has been described with reference to the preferred embodiments thereof, the present invention is not limited in its practical application and many modifications are possible without departing from the scope as stated in the appended claims. For example, the sewing motor driving device may be provided with a manual switch to operate the intermittent current control unit and to supply the motor driving current I intermittently to the sewing motor only when the manual switch is operated by the operator when the sewing machine tends to be locked. Since a high penetrating force is most necessary for the first stitching cycle, the intermittent current control unit may be operated and the motor driving current may be supplied intermittently only for the first several stitching cycles after the control pedal 7 has been operated. It is also possible to operate the intermittent current control unit and to supply the motor driving current intermittently while the sewing motor is operating at a low rotating speed.

Moreover, the present invention can be embodied in the sewing machine whose driving source is a motor other than DC motor. It can also be embodied in the sewing machine having an electromagnetic clutch for transmitting and interrupting the power of sewing motor to the main shaft. In this case, the supply of the current to the electromagnetic clutch may be controlled intermittently by the intermittent current control unit.

What is claimed is:

1. A driving device for a sewing machine, the sewing machine having a main shaft and a needle reciprocated in accordance with the rotation of the main shaft to penetrate a work fabric, said driving device comprising:

power supply means for supplying power to the main shaft so as to rotate the main shaft; and intermittent driving means for alternately generating a deenergizing signal so as to deenergize said power supply means and an energizing signal so as to energize said power supply means, said intermittent driving means generating said deenergizing signal during a period longer than a period from start of generation of said deenergizing signal until lowering of said needle is stopped, and generating said energizing signal during a period longer than a period form start of generation of said energizing signal until lowering of said needle is started.

2. The driving device for a sewing machine according to claim 1, wherein said power supply means includes a sewing motor, connecting means for operatively connecting said sewing motor with the main shaft, and electric power supply means for supplying electric power to said sewing motor.

3. A driving device for a sewing machine, the sewing machine having a needle reciprocated in order to penetrate a work fabric, said driving device comprising:

a sewing motor for reciprocating said needle;

electric power supply means for supplying electric power to said sewing motor; and intermittent driving means for alternately generating a prohibiting signal so as to prohibit said electric power supply means from supplying electric power to said sewing motor and a permitting signal so as to permit said electric power supply means to supply electric power to said sewing motor, said intermittent driving means generating said prohibiting signal during a period longer than a period from start of generation of said prohibiting signal until rising of said needle is started based on reaction force of said work fabric, and generating said permitting signal during a period longer than a period from start of generation of said permitting signal until lowering of said needle is started against the reaction force of said work fabric.

4. The driving device for a sewing machine according to claim 3, further comprising:

rotating speed detecting means for detecting a rotating speed of said sewing motor;

speed commanding means for commanding the rotating speed of said sewing motor;

deviation detecting means for detecting a rotating speed deviation by comparing the rotating speed detected by said rotating speed detecting means with the rotating speed commanded by said speed commanding means; and electric power control means for controlling the electric power supplied to said sewing motor by said electric power supply means.

5. The driving device for a sewing machine according to claim 4, further comprising:

rotating speed judging means for judging whether the rotating speed of said sewing motor is at most a predetermined rotating speed, wherein said intermittent driving means alternately generates the prohibiting signal and the permitting signal when a judgment of said rotating speed judging means is affirmative, and said intermittent driving means generates only the permitting signal when the judgment of said rotating speed judging means is negative.

6. The driving device for a sewing machine according to claim 5, wherein said rotating speed judging means judges whether the rotation speed detected by said rotating speed detecting means is at most the predetermined rotating speed.

7. The driving device for a sewing machine according to claim 5, wherein said rotating speed judging means judges whether the rotation speed commanded by said speed commanding means is at most the predetermined rotating speed.

8. The driving device for a sewing machine according to claim 4, further comprising:

load judging means for judging whether a load applied to said sewing motor is at least a predetermined load, wherein said intermittent driving means alternately generates the prohibiting signal and the permitting signal when a judgment of said load judging means is affirmative, and said intermittent driving means generates only the permitting signal when the judgment of said load judging means is negative.

9. The driving device for a sewing machine according to claim 8, wherein said load judging means judges whether the rotating speed deviation detected by said deviation detecting means is at least a predetermined rotating speed deviation.

10. The driving device for a sewing machine according to claim 8, further comprising:

current detecting means for detecting a current supplied to said sewing motor by said electric power supply means, wherein said load judging means judges whether the current detected by said current detecting means is more than a predetermined current.

11. A driving device for a sewing machine having a reciprocable needle, said driving device comprising:

a sewing motor for reciprocating said needle;

electric power supply means for supplying electric power to said sewing motor;

judging means for judging whether said sewing motor is nearly locked; and vibrating means for vibrating said needle in a reciprocating direction thereof by controlling said electric power supply means to intermittently supply electric power to said sewing motor when a judgment of said judging means is affirmative.

12. The driving device for a sewing machine according to claim 11, wherein said vibrating means includes intermittent driving means for alternately generating a prohibiting signal so as to prohibit said electric power supply means from supplying electric power to said sewing motor and a permitting signal so as to permit said electric power supply means to supply electric power to said sewing motor.

13. The driving device for a sewing machine according to claim 12, wherein said intermittent driving means generates said prohibiting signal during a period longer than a period from start of generation of said prohibiting signal until rising of said needle is started and generates said permitting signal during a period longer than a period from start of generation of said permitting signal until lowering of said needle is started.

14. The driving device for a sewing machine according to claim 11, wherein said judging means includes rotating speed detecting means for detecting a rotating speed of said sewing motor, and wherein said judging means judges whether the rotating speed of said sewing motor is at most a predetermined rotating speed.

15. The driving device for a sewing motor according to claim 11, wherein said judging means includes load detecting means for detecting a load applied to said sewing motor, and wherein said judging means judges whether the load of said sewing motor is at least a predetermined load.

* * * * *